United States Patent [19]

Schmidt et al.

[11] Patent Number: 4,712,937

[45] Date of Patent: Dec. 15, 1987

[54] PLOTTER STYLUS WITH CAP COVERED VENT

[75] Inventors: Rolf Schmidt, St. Georgen; Roland Schneider, Tennenbronn, both of Fed. Rep. of Germany

[73] Assignee: Schmidt Feintechnik GmbH, Fed. Rep. of Germany

[21] Appl. No.: 721,466

[22] Filed: Apr. 9, 1985

[30] Foreign Application Priority Data

Apr. 28, 1984 [DE] Fed. Rep. of Germany ..... 3415859

[51] Int. Cl.[4] ..... B43K 9/00; B43K 7/00

[52] U.S. Cl. ..... 401/213; 401/199; 401/202; 401/209; 401/217; 401/227; 401/258

[58] Field of Search ..... 401/135, 198, 199, 209, 401/225, 259, 258, 260, 227, 226, 228, 229, 217, 202, 213

[56] References Cited

U.S. PATENT DOCUMENTS

| | | | |
|---|---|---|---|
| 396,547 | 1/1889 | De Normanville | 401/229 |
| 2,512,004 | 6/1950 | Wing | 401/226 |
| 2,514,729 | 7/1950 | Snodgrass | 401/226 |
| 2,681,041 | 6/1954 | Zodtner et al. | 401/227 X |
| 2,766,728 | 10/1956 | Kovacs | 401/227 |
| 2,921,558 | 1/1960 | Von Platen | 401/226 X |
| 2,987,044 | 6/1961 | Young | 401/227 |
| 3,645,636 | 2/1972 | Mutschler | 401/227 |
| 4,382,707 | 5/1983 | Anderka | 401/198 |
| 4,461,591 | 7/1984 | Mutschler | 401/259 |
| 4,556,336 | 12/1985 | Sano et al. | 401/225 X |

FOREIGN PATENT DOCUMENTS

| | | | |
|---|---|---|---|
| 1259733 | 11/1964 | Fed. Rep. of Germany | 401/225 |
| 2345906 | 5/1974 | Fed. Rep. of Germany | 401/209 |
| 557422 | 3/1975 | Japan | 401/209 |

*Primary Examiner*—Steven A. Bratlie
*Attorney, Agent, or Firm*—Eric P. Schellin

[57] ABSTRACT

The plotter stylus has a writing point (10) which is connected to the ink cartridge (50) via the ink duct (40). The ink duct (40) is surrounded by a pressure compensator (20) and connected thereto. In the pressure compensator a compensator element (21) is provided with annular chambers (23) which absorb surplus ink emerging from the ink duct (40) in the case of temperature or pressure increases. The annular chambers have no capillarity for the ink. Air is introduced via the air inlet orifice (28) located above the chambers (23). The ink cartridge (50) is exchangeable.

1 Claim, 2 Drawing Figures

PLOTTER STYLUS WITH CAP COVERED VENT

BACKGROUND OF THE INVENTION

1. Field of the Invention

The invention relates to a plotter stylus. A plotter stylus is a writing stylus for a plotter, that is to say for a machine for the automatic graphic representation of lines, symbols, diagrams or the like.

2. Description of the Prior Art

Hitherto ink pens, ball-point pens, particularly those with liquid inks, fiber-tip pens and felt-tip pens have been used as plotter styluses. Because plotters frequently operate at high writing speeds, it is scarcely possible to avoid failures with the known plotter styluses. Plotter styluses with the greatest possible writing lengths are also necessary in order to permit recordings to be made without interruption.

Known plotter styluses do not yet fulfill these conditions satisfactorily.

It is therefore the task of the invention to develop to a plotter stylus which permits high writing speeds, has a large ink volume, and also ensures as constant ink delivery independent of the ink supply with total utilization of the ink.

The achievement of this task starts with an ink writing implement, wherein the ink duct connecting the writing point to the ink supply space is surrounded by a pressure compensator. Such ink writing implements, which are described in detail in German Patent No. 2,609,668, for example, have been developed particularly for manual operation. The pressure compensator provided in these implements, also called a regulator, has the function of absorbing surplus ink in the case of variations in pressure, temperature or position, so that this ink does not emerge from the writing implement through the writing point.

In order to retain the ink in the pressure compensator of a manual implement under the various working and operating conditions, it is necessary for the chambers of the pressure compensation means to be dimensioned so that they retain the ink by virtue of their capillarity. However, this means that the fins demarcating the chambers must be arranged at very short mutual intervals, which are on the order of magnitude of 0.1 mm to 0.2 mm. In order to create a large volume for the pressure compensator in the smallest possible space, it is also essential for the fins to be dimensioned very thinly; their thickness is generally on the order of magnitude of 0.3 mm.

The production of pressure compensators with such fine lamellae is difficult and costly. Furthermore, the volume of these pressure compensators is too small for plotter styluses. Moreover, the capillarity of the pressure compensator has the disadvantageous effect that the quantity of the ink delivered via the writing point is a function of the volume of the ink still present in the supply space, and that a part of the ink is retained by capillary forces in the pressure compensator; therefore, the ink cannot be utilized totally.

A plotter stylus equipped with a pressure compensator which is free from these disadvantages is proposed according to the invention.

SUMMARY

In the plotter stylus constructed according to the invention a pressure compensator is provided with chambers which themselves have no capillarity. In the case of a plotter stylus, in fact, the capillarity of the pressure compensator chambers is unnecessary if, as is further proposed, differently from the case of manual writing implements, the air inlet orifice which serves to connect the pressure compensator to the atmosphere is located above the chambers in the writing position of the stylus. The production of such a pressure compensator with fins approximately 1 mm thick and with a mutual interval of 1 mm is far simpler and cheaper. Such a pressure compensator, as compared to the known pressure compensators, also has a larger ink storage volume with the same dimensions.

However, as a variant of the proposal according to the invention, the gaps and/or channels demarcated by the fins and the internal wall of the housing, in contradistinction to the annular chambers demarcated by fins, may have capillarity for the writing ink. In the case of ink writing implements for manual use, the greatest risk of ink escaping is when the writing implement is exposed to different temperature and pressure conditions with simultaneous changes of position during transport from one place to another, in the user's jacket pocket for example.

In the case of a plotter stylus, this risk only arises during the transport to the plotter, which generally operates while stationary. In order to prevent reliably any escape of ink on this journey, it is recommended, as further proposed by the invention, that the ink supply space, be provided, as already known in the case of manual writing implements, in a separate ink cartridge which is preferably inserted into the plotter stylus only at the place of use.

The use of a detachable ink cartridge in a plotter stylus also presents two further advantages. On the one hand, the plotter stylus need not be exchanged when the supply of ink has been consumed. On the contrary, a fresh cartridge can be inserted. To permit the consumption of the ink to be observed and detected in good time, it is recommended, as is further proposed by the invention, that a cartridge made of transparent material be used.

On the other hand, the detachability of the cartridge also permits a color change without difficulty. The cover of the cartridge is conveniently provided with a color marking, or itself consists of colored material. The cover may also carry other markings, such as the filling date, for example.

The ball points known in ball-point pens, in addition to felt or fiber writing points, and points made of extruded plastics are suitable for the application of the writing ink conveyed out of the ink supply space via the ink duct to the writing point.

BRIEF DESCRIPTION OF THE DRAWINGS

A exemplary embodiment of the invention is also described in detail with reference made to the drawing, wherein.

Detailed Description

Figure 1:
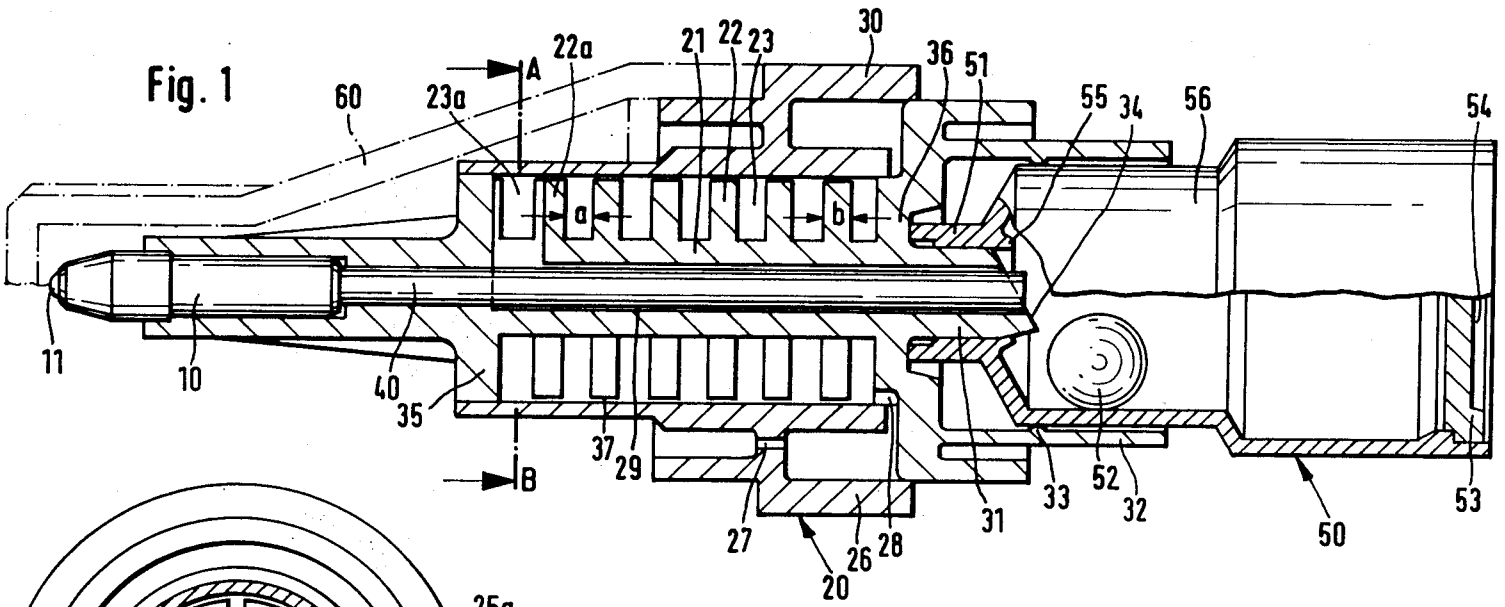
FIG. 1 shows an axial section of a plotter stylus according to the invention with protective cap indicated and FIG. 2 shows a radial section along the line A–B in FIG. 1.

As may be seen from FIG. 1, the plotter stylus according to the invention consists of the following subassemblies:

writing point 10 with writing ball 11, pressure compensator 20 with compensator element 21, ink cartridge 50, ink duct 40, which extends from writing point 10 into the ink space of ink cartridge 50. Protective cap 60, which is fitted onto the writing point only during storage, transport or also in the state of rest. It particularly prevents the ink from drying up, but also affords protection against mechanical damage.

For a better understanding of the construction of the plotter stylus, particularly of the composition of the pressure compensator, the physical mode of operation will be explained first. It must be stated beforehand that the writing position of the plotter stylus is rotated approximately through 90° relative to that illustrated in FIG. 1.

In this position the ink present in ink cartridge 50 accumulates in tapered headpiece 56, out of which it is transported by the effect of the capillary force of ink duct 40, and if the capillary channels machined in writing point 10, to writing ball 11.

During the writing process ink is consumed, whereby a negative pressure occurs in ink cartridge 50, which is connected in an air-tight and liquid-tight manner to regulator 20. For the purpose of pressure compensation, air passes out of the ambient atmosphere via air inlet orifices 27 and 28, annular chambers 23 of pressure compensator 20 and annular gap 29 between ink duct 40 and compensator element 21 into the interior of ink cartridge 50. No inlet of air must occur through writing point 10 or also the socket of the writing point or through the gap between cartridge neck 51 and pressure compensator projection 31, since otherwise the writing flow will be interrupted during writing or drops will form on writing ball 11.

The pressure compensator 20 consists of a housing 26, in which compensator element 21 is located. This compensator element 21 has a series of coaxially arranged annular fins 22, which are arranged at a mutual interval a so that they demarcate annular chambers 23. The intervals a, which are 1.1 mm in the preferred exemplary embodiment, are chosen so that the annular chambers have no capillarity for the writing ink. The thickness b of annular fins 22 is approximately on the same order of magnitude; it is precisely 0.9 mm in the exemplary embodiment.

Figure 2:
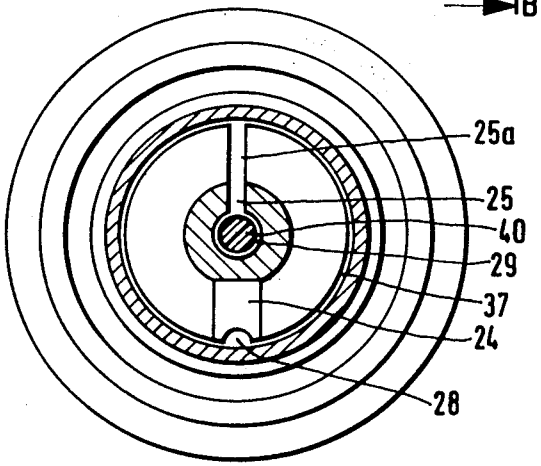

The diameter of annular fins 22 is slightly smaller than the internal diameter of housing 26, so that annular gaps 37 are formed between the circumferential surfaces and the housing inner wall; however, they may be dimensioned so that they exert capillary forces on the writing ink. Annular fins 22 are fixed in their position relative to housing 26 by end flanges 35 and 36, which abut the internal wall of the housing 26 in a fluid-tight manner. All annular chambers 23 are mutually connected via an ink channel 24 oriented parallel to the axis, which is formed by cutting a rectangular segment out of the annular fins, as is clearly shown by FIG. 2 of the drawing and by the absence of hatching on fins 22 beneath ink duct 40 in FIG. 1. Ink channel 24 may also have capillarity for ink if required. In addition, and as already mentioned above, annular chambers 23 are mutually connected via capillary gaps 37 between fins 22 and the internal wall of housing 26. Chamber **23*a* adjacent to writing point 10 is connected directly to ink duct 40 via a capillary gap 25. This gap 25 is adjoined by connecting channels 25*a* provided in fin 22*a* and/or in flange 35 and open towards chamber 23*a*, which extend as far as the annular gap between fins 22 and the internal wall of housing 26**.

This pressure compensator functions in the following manner.

In the case of heating or increase of pressure, particularly of the air space above the stationary ink in ink cartridge 50, this ink is forced by volume expansion of the air out of ink duct 40 into annular gap 29 and initially into chamber **23*a*. When chamber 23*a* is filled, the subsequent chambers 23 become filled from the bottom upwards, on the one hand via capillary annular gaps 37 between annular fins 22 and the housing internal wall, and of the other hand via axial ink channel 24. In the case of cooling or pressure reduction, the ink absorbed by the pressure compensator passes back in the reverse direction into the ink cartridge. Because the air vent orifice 28 is located above the last chamber 23** in the writing position of the plotter stylus, no escape of ink is possible.

Due to the lack of capillarity of chambers 23, it is recommended that ink cartridge 50 be connected to the plotter stylus only at the place of use. For this purpose ink cartridge 50 should be inserted by its tapered headpiece 56 into cylindrical receiver 32 of pressure compensator 20. Cylindrical projection 31 of compensator element 21 then penetrates into cartridge neck 51 and presses ball 52, which closes the internal orifice of neck 51, into the interior of the cartridge. In the still unused cartridge 50, ball 52 is connected to that part of neck 51 which is located in the interior of the container and is constructed as a sealing lip 55, and is preferably pressed into the latter.

The projection 31 is bevelled at its end protruding into the cartridge. This bevelling causes the air during pressure compensation to emerge into the interior of the cartridge only in the form of small bubbles, which prevents surges in the ink flow.

In order to ensure a fluid-tight closure between cartridge neck 51 and projection 31, which is important for the correct function, cartridge neck 51 is constructed on its inside as a resilient sealing lip 55, which abuts in an air-tight and liquid-tight manner against the outside of projection 31. The security of the position of cartridge 30 within housing 32 is ensured by catch lands 33 which abut the external surface of headpiece 56 or engage into recesses provided there.

The filling of cartridge 50 is effected via the rear orifice, which is closed by cover 53.

The cover surface 54, recessed somewhat relative to the edge of the cover, is advantageously suitable for color or text markings.

We claim:

1. An elongated cylindrical plotter pen comprising a liquid ink distribution means at its distal end, a cap adapted and constructed to cover said distribution means, a liquid ink reservoir means at its proximal end, a cylindrical housing means having an inner cylindrical wall positioned between said ink distribution means and said ink reservoir means, an ink duct means positioned centrally and coaxially in said cylindrical housing means adapted and constructed to capillary convey ink from said ink reservoir means to said ink distribution means, a cylindrical hollow core means positioned internally and coaxially of said cylindrical housing means and about said ink duct means at a capillary producing distance, said core means having a plurality of radially outwardly extending fins defining annular spaces there-between each having outwardly facing peripheral portions, said peripheral portions of said fins being spaced from the inner cylindrical wall of said cylindrical housing means for a capillary producing distance, said fins and said spaces each define an axial dimension of about the same distance, means for fluidly connecting said ink duct means and the annular space closest to said ink distribution means, relatively large means for fluidly connecting each of said annular spaces in said core means, said cylindrical housing means having a separate annular chamber annularly about said core means and remote therefrom, a first vent means for fluidly connecting the annular space closest to the ink reservoir means through said cylindrical housing means to said annular chamber, said annular chamber having a second vent means for fluidly connecting the annular chamber to the ambient atmosphere only when said cap is removed from said plotter pen.

* * * * *